US008079726B1

(12) United States Patent
Hui et al.

(10) Patent No.: US 8,079,726 B1
(45) Date of Patent: Dec. 20, 2011

(54) POOL LIGHT ASSEMBLY

(75) Inventors: Wing-kin Hui, Hong Kong (HK); Wing-tak Hui, Hong Kong (HK)

(73) Assignee: Heng Kang Slate Lo, Ltd., Hong Kong (HK)

( * ) Notice: Subject to any disclaimer, the term of this patent is extended or adjusted under 35 U.S.C. 154(b) by 0 days.

(21) Appl. No.: 12/854,170

(22) Filed: Aug. 11, 2010

(51) Int. Cl.
*F21V 33/00* (2006.01)

(52) U.S. Cl. ..... 362/101; 362/96

(58) Field of Classification Search ..... 362/96, 362/101, 267, 477
See application file for complete search history.

(56) References Cited

U.S. PATENT DOCUMENTS 5,122,936 A * 6/1992 Guthrie ..... 362/101
6,702,451 B1 * 3/2004 Daane ..... 362/96
2006/0002105 A1 * 1/2006 Hinojosa ..... 362/101
* cited by examiner

*Primary Examiner* — Laura Tso
(74) *Attorney, Agent, or Firm* — Pennsula IP Group; Douglas Chaikin

(57) ABSTRACT

Disclosed herein is a pool light fixture assembly. The assembly is connected to a pool wall and includes a light adapter and a return fitting. At least two channels, a water channel and an electrical channel run through the assembly. Each of the channels is parallel to one another. However, the electrical channel is parallel to and separate from the water channel. In one embodiment only a portion of the electrical channel is parallel to the water channel in the return fitting portion of the assembly. The adapter includes a light fixture for connection with light(s). The light fixture is within and/or adjacent to the electrical channel.

23 Claims, 8 Drawing Sheets

POOL LIGHT ASSEMBLY

FIELD OF THE INVENTION

This invention relates generally to the field of pool equipment, either above or in-ground pools. More particularly, this invention relates to fixtures that are designed for pool light assemblies. Typically, such fixtures are designed exclusively either for above ground pools or exclusively for in-ground pools.

BACKGROUND OF THE INVENTION

Pool lighting has become more and more popular in the recent past. Pool lighting has been around for many years. Initially pool lighting was used strictly for safety purposes. Night time swimming, although not terribly popular, was done with much greater safety at night with lighted pools for obvious reasons.

After adding lighting, pool owners and others noticed that calming effort of night time lighting. Visitors and pool owners alike noticed the tranquil effect sitting by the pool at night had.

Later, enhancements to lighting were developed. For example, color lighting was added as a feature to pools. Such lighting provided viewers with greater interest and had the same or greater benefits to peaceful and tranquil viewing. Additional enhancements such as sequential color lighting were further added.

As would be expected, one must provide conduit for powering the lighting. Typically, the place chose to add such conduit has been the return fitting. However, adding conduit to the return fitting presents additional challenges. For example, the free flow of water into the pool is impeded when channel for the conduit is placed is the existing channel for water.

In some installations, e.g. U.S. Pat. No. 5,207,499, the light and the light fixture are placed in the water channel for the return fitting. Other examples of such light fixture installations are set forth in U.S. Pat. No. 7,188,378. The '378 patent represents an advancement of the art. The '378 patent includes an electrical access conduit in the water channel. However, as depicted in the '378 patent the channel is immediately adjacent the side wall of the water channel. Therefore the electrical channel or electrical access conduit does not provide a barrier as great as the earlier described '499 patent. Nevertheless, what is referred to as the electrical access conduit by the '378 patent is still in the water channel and is still blocking the free flow of water through the return fitting.

What is needed is a lighting installation does not block the free flow of water through the water return fitting of the pool. What is also needed is a pool lighting fixture, which provides a structure for virtually ensuring that leakage will not result from such an electrical conduit line.

SUMMARY OF THE INVENTION

The structure for an improved pool light assembly in accordance with the present invention eliminates the need for having an electrical conduit within the water channel of the pool light assembly. Instead the electrical conduit channel is internally within the pool light assembly and is separate and apart from the water channel. Typically, the pool light assembly in accordance with this invention includes a first member defining the pool light fixture and a second member defining a return fitting. Each of the members includes a first and a second channel through the body of each member. The channels are separate and apart from one another and in various embodiments are parallel, at least partially, through the body of the members. The channels include a water channel and an electrical channel, which are aligned through the members.

It is an object of this invention is to provide a pool light assembly, which includes an electrical channel separate and apart from the water channel.

It is another object of this invention to provide a pool light assembly, which includes an electrical channel and a free flowing return fitting, where water flows through the water channel without being obstructed by an electrical channel.

In accordance with the objects set forth above and as will be described more fully below, the pool light assembly in accordance with this invention, comprises:

a light adapter defining an internal body and having the water and electrical channels within the internal bodies, each of the channels parallel to one another, the light adapter including a light fixture member for connection with a light;

a return fitting defining an internal body and also having the water and electrical channels within the internal bodies, the water and electrical channels aligned and extending through each of the return fitting and the light adapter for allowing water to freely flow through the light fixture assembly and for allowing electrical connection with the light fixture member; and at least the light adapter portion of the electrical channel being parallel to and separate from the water channel and the electrical channel being within the internal bodies of the adapter and the return fitting, respectively.

In one exemplary embodiment, the light adapter comprises a two piece assembly. And, in an additional refinement of this exemplary embodiment, the first piece defines a clear lens cover and the second piece defines a base; the base adapted for connection with the return fitting and the base including the light fixture and the clear lens connecting with the base directly over the light fixture In another exemplary embodiment, the light assembly includes the light adapter being adapted for immersion with the pool water and the water channel feeding directly into the pool water when the pool light fixture assembly is set within the pool and the pool water has filled the pool and the electrical channel being adapted to fit a side-by-side electrical wiring harness for powering the light through the electrical channel.

In still another exemplary embodiment, the assembly includes a plurality of lights; each of the lights having its own electrical channel. In a further refinement of this embodiment, the lights form a circular pattern around the water channel.

Of course, various other exemplary embodiments are possible to achieve various objects of the invention within the spirit and scope of this invention.

It is an advantage of the pool light assembly of this invention to provide a structure that has a water channel free from obstructions and remains free flowing despite the addition of one or more electrical channels within the assembly.

It is an additional advantage of the pool light assembly in accordance with the instant invention to provide to both above and in-ground pools with such a lighting assembly.

It is an additional advantage of the pool light assembly in accordance with the instant invention to provide to new and existing pool structures with such a lighting assembly.

BRIEF DESCRIPTION OF THE DRAWING

For a further understanding of the objects and advantages of the present invention, reference should be had to the following detailed description, taken in conjunction with the accompanying drawing, in which like parts are given like reference numerals and wherein.

DETAILED DESCRIPTION OF THE INVENTION

In order to appreciate the invention herein, one must appreciate the need in the art as set forth in the Background. Most importantly, the structure herein for resolving the long felt need to have a light assembly which includes an electrical channel separate and apart from the water channel as represented by the various exemplary embodiments in accordance with the disclosed invention.

Figure 1:
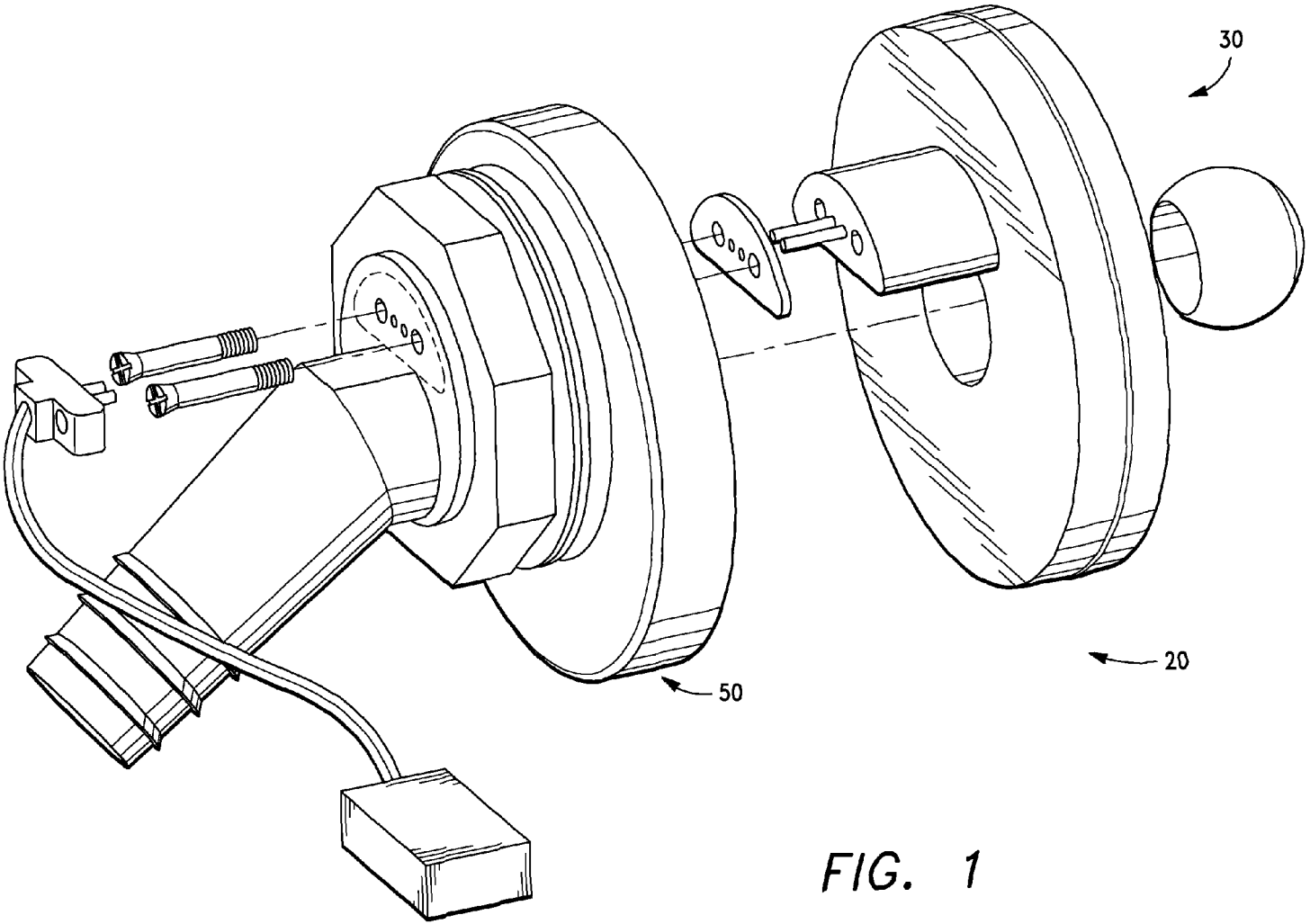
FIG. 1 is an exploded view of the pool light assembly in accordance with this invention.

With particular reference to FIG. 1, there is shown an exemplary embodiment of the pool light assembly, generally denoted by the numeral 20. The pool light assembly 20 includes a light adapter 30 and a return fitting 50. The pool light assembly 20 is secured to a pool wall and in an existing pool replaces the replaces the existing fitting 30.

With respect to FIGS. 1-5, there are shown the single electrical channel and various other exemplary embodiments of the light adapter 30. With particular respect to FIG. 4, there is shown the single electrical channel embodiment, generally denoted by the numeral 100.

The embodiment 100 includes a light adapter 130 having two members 132 and 134. Member 132 is a clear plastic lens 136. Member 134 defines a body for interconnecting the light adapter with the return fitting 50 (FIG. 1).

Member 132 interconnects with member 134 and is removable therefrom. As will be appreciated below, this facilitates ease of changing the light itself, when desired. Additionally, while the embodiment described in FIG. 4 includes a clear plastic lens, a clear glass lens is certainly within the spirit and scope of the invention. Additionally, in other exemplary embodiments, the lens is a single color or multi-colored, also within the spirit and scope of the invention.

The body of member 134 defines a water channel 138. At the distal end of the water channel 138, a nozzle 140 is provided so as to direct the flow of water therethrough. The nozzle 140 is twistable defining an eyeball nozzle.

As shown, the water channel extends through the body of member 134 and the return fitting 50. The openings in each of those elements are aligned so as to create a single water channel 138.

Figure 2:
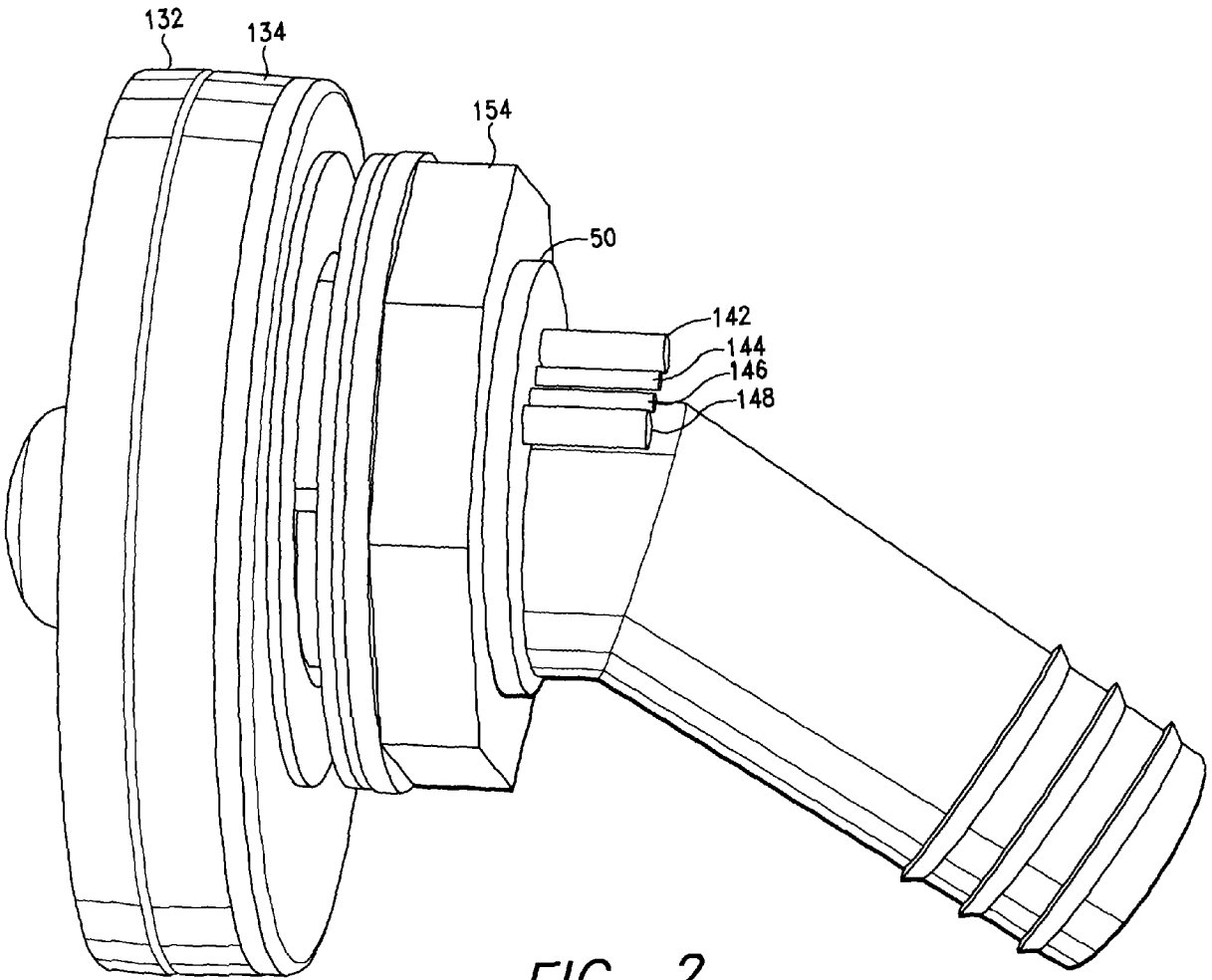
FIG. 2 illustrates an exemplary embodiment of the pool light assembly return fitting in accordance with this invention, shown as assembled.
Figure 3:
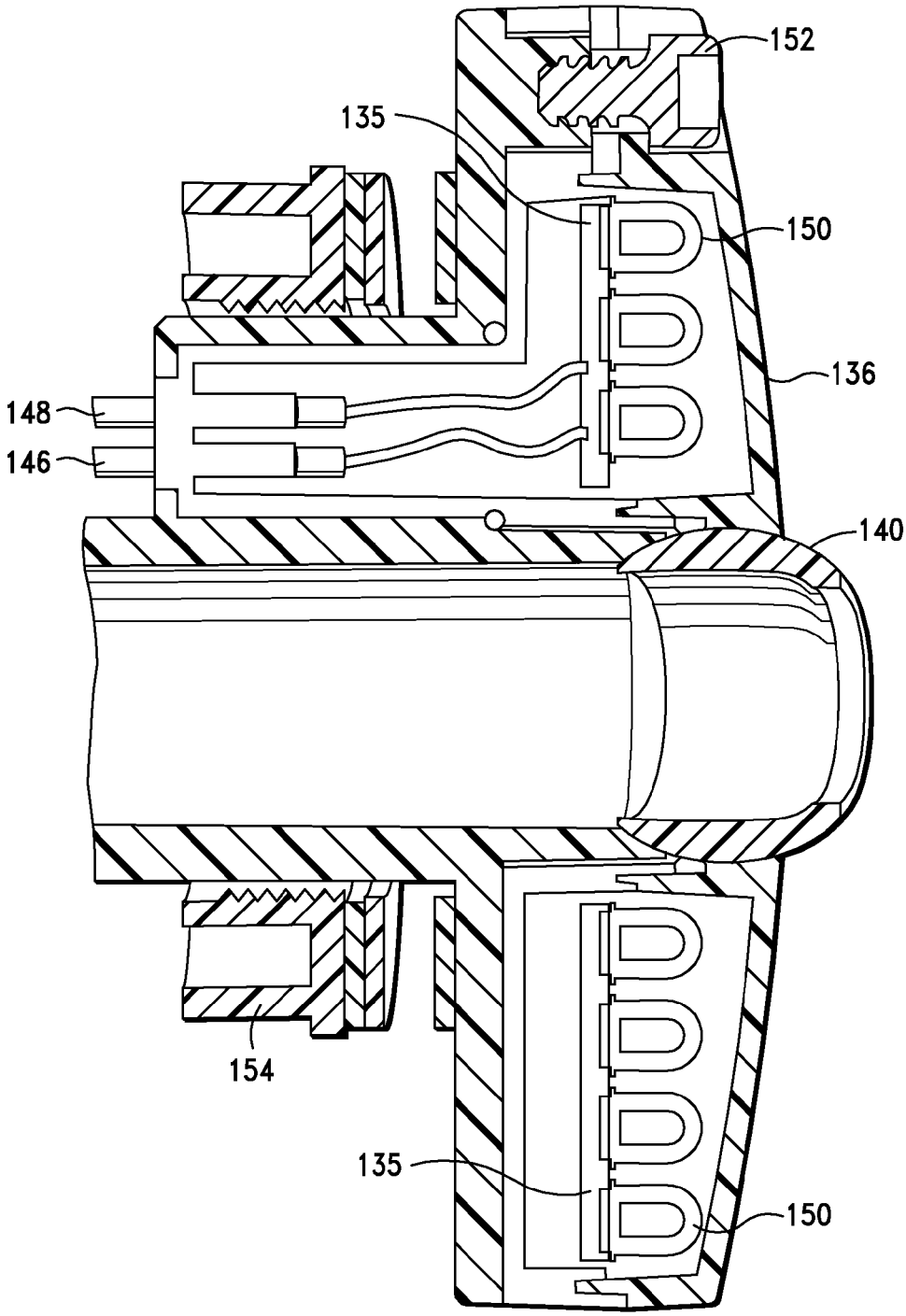
FIG. 3 illustrates an exemplary embodiment of the pool light assembly light adapter in accordance with this invention, shown as assembled.
Figure 4:
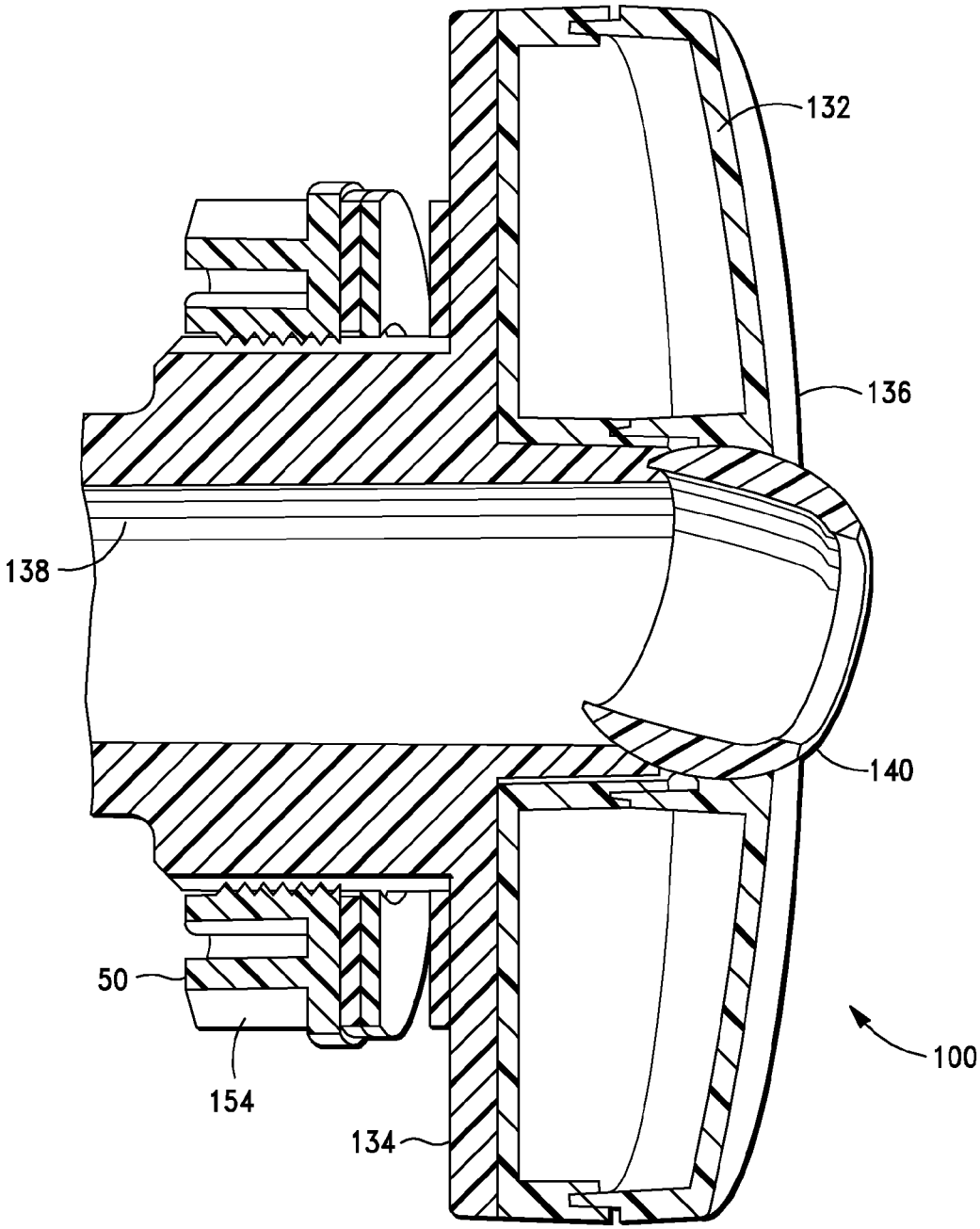
FIG. 4 illustrates a cross sectional view of an exemplary embodiment the light adapter in accordance with this invention.

With particular reference to FIGS. 2 & 3, there is shown a multi-electrical channel embodiment. FIG. 2 illustrates electrical channels 142 through 148 in the return fitting 50. As shown with reference to FIG. 3, the channels 142 through 148 extend through the body of member 134 until wires reach the lights 150.

In a single light embodiment having a single electrical channel, there would of course, be only one light and one such channel. There is no need to separately illustrate such a single electrical channel embodiment since the form and function of the channel is precisely the same whether it is a single or multiple channel embodiment.

The members 132 and 134 are releaseably held together by a screw 152 through the lens 132 into the body of member 134. The screw 152 extends through the body of member 134 and is securely fastened into the return fitting 50 as shown in FIG. 3.

The light adapter member 134 includes a light fixture 135. In the exemplary embodiment shown in FIG. 3 there are 7 separate lighting structures defining lights 150. Here, the light fixture 135 includes an electrical board, such as a PC board. In other exemplary embodiments such a PC board is connected to a micro-processor and turns on the lights sequentially or randomly or semi-randomly or in a programmed manner depending upon the desire of the user and in ways conventional in the art.

The return fitting 50 includes a nut 154. The body of the return fitting 50 is located on the dry side of the pool wall while the light adapter is on the water side of the light assembly. Upon assembly of the return fitting 50 with the light adapter, the nut 154 is tightened against the pool wall in ways conventional in the art.

As will be appreciated, in the exemplary embodiments described above, the water channel 138 is parallel to the electrical channel or channels. It will also be appreciated that the electrical channel or channels are separate and apart from the water channel. Thereby, the electrical channel is not within the water channel and water is allowed to flow freely without obstruction from any of the electrical channels.

Figure 5:
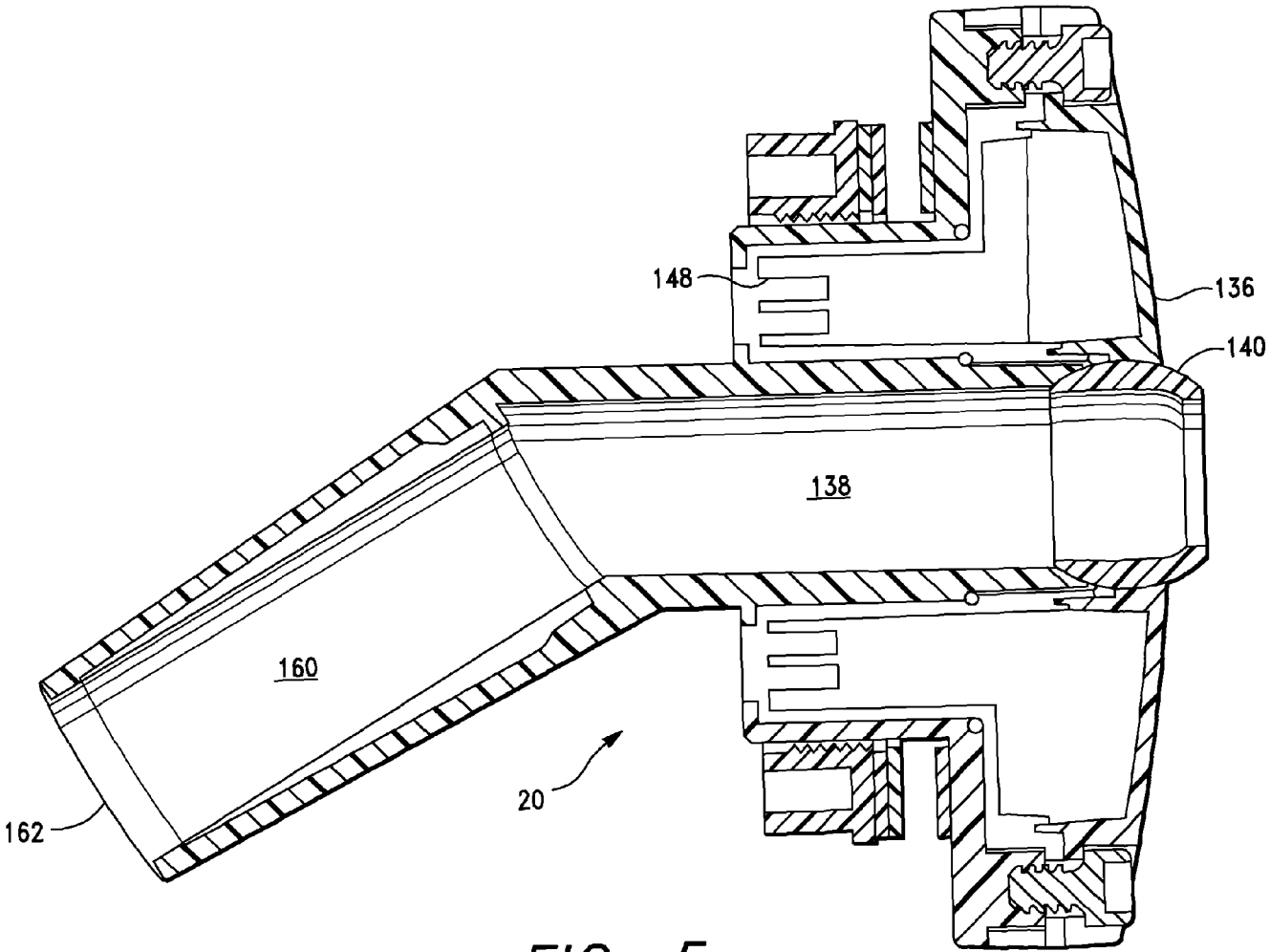
FIG. 5 illustrates another exemplary embodiment of the pool light assembly in accordance with this invention, shown as assembled.

FIG. 5 illustrates an exemplary embodiment of the fully assembled pool light assembly 20. The water channel 138 extends through both the light adapter and the return fitting elements of the pool light assembly 20. Additionally, a portion of the water channel 160 extends beyond the light fitting body. This extension 160 is not parallel to the other channels and because it is beyond the return fitting, there exists no need for it to be so. The extension 160 defines a proximal end 162, which is adapted to fit a water source, such as a garden hose.

Figure 6:
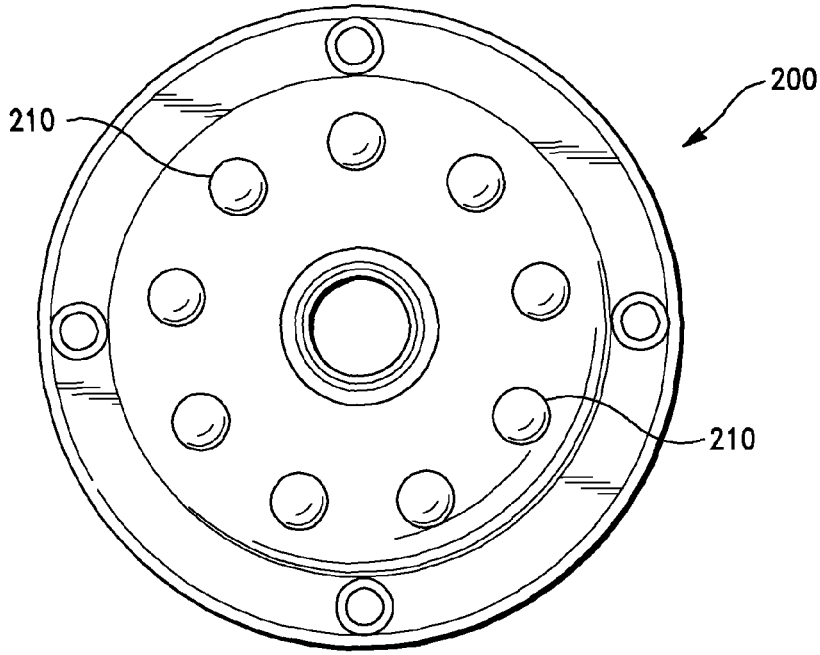
FIG. 6 illustrates another exemplary embodiment of the pool light assembly having a ring of lights in accordance with this invention.

With particular reference to FIG. 6, there is shown another exemplary embodiment of the pool light assembly 200. In this embodiment, there exists multiple lights 210. In particular, there are nine lights, which form a ring around the nozzle 140. As described above, the lights in an exemplary embodiment are electrically connected through multiple electrical channels and are attached to a PC or similar electrical board and then to a microprocessor for the desired programming.

Figure 7:
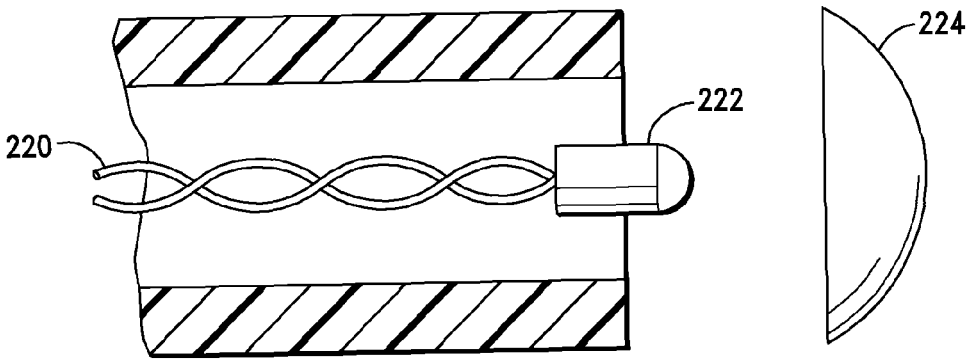
FIG. 7 illustrates the details of the light fixture of the pool light assembly in accordance with this invention.

FIG. 7 illustrates a twisted wire pair 220 electrically connecting the light 222. The light is connected in a single channel in the manner described above. A clear plastic lens 224 fits over the light 222, sealing the light fixture and protecting the light from contact with the water.

Figure 8:
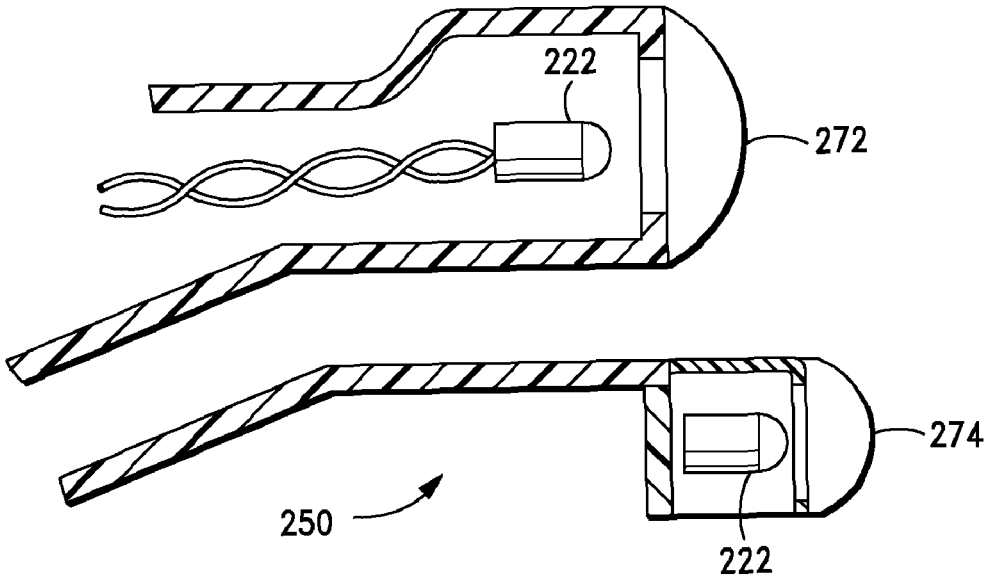
FIG. 8 illustrates the details of the multi-light fixture exemplary embodiment of the pool light assembly in accordance with this invention.
Figure 9:
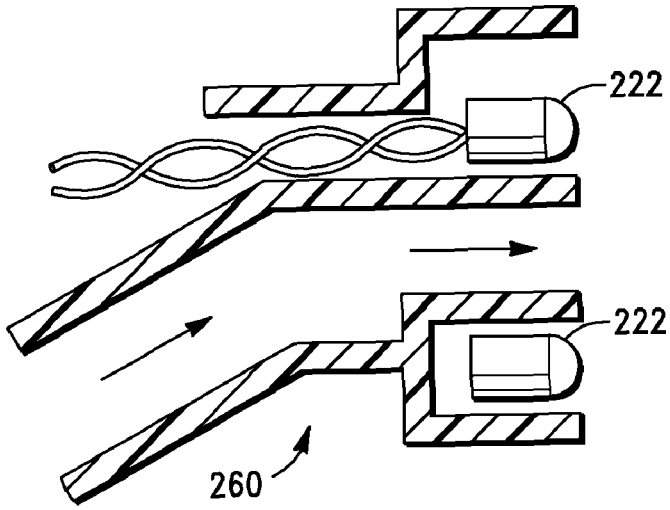
FIG. 9 illustrates the details of the multi-light, multi-channel light fixture exemplary embodiment of the pool light assembly in accordance with this invention.

FIGS. 8 and 9 illustrate different exemplary embodiments of the multi-electrical channel light adapter 250 and 260, respectively. The embodiment 250 includes multiple lights 222 having an offset as shown. Each light 222 has its own electrical channel 270 and its own lens 272 and 274. As shown, the lens are differently sized and secure and seal the light from the pool water.

FIG. 9 is similar, but there is no offset for lights 222 and the lights are of the self contained variety. Thus, no lens for sealing is necessary in this embodiment.

Figure 10:
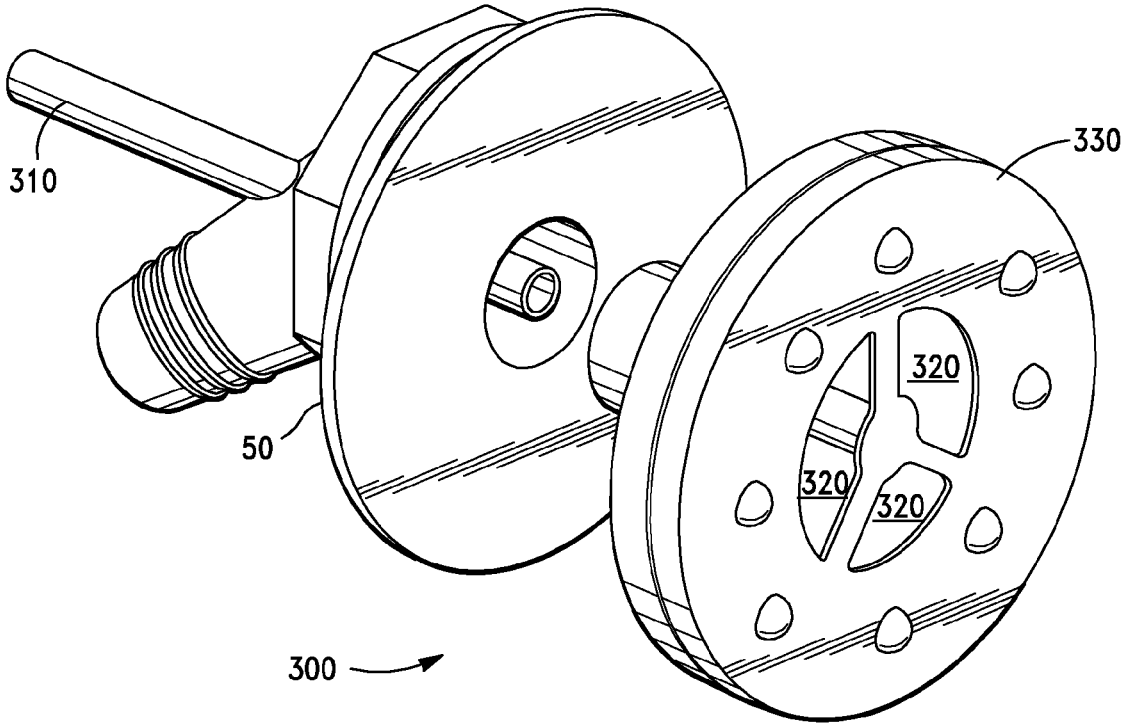
FIG. 10 illustrates another exemplary embodiment of the pool light assembly having a ring of lights in accordance with this invention.

FIG. 10 illustrates another exemplary embodiment of the pool light assembly 300. In this embodiment, the electrical channel 310 extends beyond the return fitting 50. Again, in this embodiment, after extending beyond the return fitting 50, the electrical channel 310 is no longer parallel to the water channel. Additionally, there are multiple water channels 320 in this embodiment.

The electrical channel 310 defines a single electrical channel, which is surrounded by three water channels 320. Again, in this embodiment, throughout the light adapter 330 and the pool fitting 50, the water channels 320 are parallel and separate and apart from the electrical channel 310. Thus again in this embodiment, water flows freely, without obstruction of any kind from the electrical channel 310.

While the foregoing detailed description has described several exemplary embodiments of the pool light fixture assembly in accordance with this invention, it is to be understood that the above description is illustrative only and not limiting of the disclosed invention. Thus, the invention is to be limited only by the claims as set forth below.

What is claimed is:

1. A pool light fixture assembly for use with above ground and in-ground pools, the assembly connected to the pool wall, comprising:

a light adapter having at least two channels, a water channel and an electrical channel, each of the channels parallel to one another, the light adapter including a light fixture member for connection with a light;

a return fitting also having the water and electrical channels, the water and electrical channels aligned and extending through each of the return fitting and the light adapter for allowing water to freely flow through the light fixture assembly and for allowing electrical connection with the light fixture member; and at least the light adapter portion of the electrical channel being parallel to and separate from the water channel.

2. The pool light fixture assembly as set forth in claim 1, wherein the light adapter defines a two piece assembly, the first piece defining a clear lens cover and the second piece defining a base; the base adapted for connection with the return fitting and the base including the light fixture and the clear lens connecting with the base directly over the light fixture.

3. The pool light fixture assembly as set forth in claim 1, wherein the light adapter is adapted for immersion with the pool water and water channel feeds directly into the pool water when the pool light fixture assembly is set within the pool and pool water has filled the pool and wherein the electrical channel is adapted to fit a side-by-side electrical wiring for powering the light.

4. The pool light fixture assembly as set forth in claim 3, wherein the return fitting includes a nut member and the nut member is adapted to tighten the assembly to the pool wall.

5. The pool light fixture assembly as set forth in claim 1, wherein the assembly has more than one electrical channel; each channel parallel to and separate from the water channel.

6. The pool light fixture assembly as set forth in claim 5, wherein the light fixture member includes a plurality of lights, each light being accessed by an electrical channel.

7. The pool light fixture assembly as set forth in claim 6, wherein the light fixture member defines a rotary array of lights.

8. The pool light fixture assembly as set forth in claim 7, wherein the lights are of two different colors

9. The pool light fixture assembly as set forth in claim 7, wherein the lights are of more than two colors and are sequentially activated.

10. A pool light fixture assembly for use with above ground and in-ground pools, the assembly connected to the pool wall, comprising:

a light adapter having at least two channels, a water channel and an electrical channel, each of the channels parallel to one another, the light adapter including a light fixture member for connection with a light;

a return fitting also having the water and electrical channels, the water and electrical channels aligned and extending through each of the return fitting and the light adapter for allowing water to freely flow through the light fixture assembly and for allowing electrical connection with the light fixture member;

at least the light adapter portion of the electrical channel being parallel to and separate from the water channel; and the adapter including a nozzle end.

11. The pool light fixture assembly as set forth in claim 10, wherein the nozzle end rotates.

12. The pool light fixture assembly as set forth in claim 11, wherein the nozzle end defines an eyeball socket.

13. The pool light fixture assembly as set forth in claim 10, wherein the return fitting includes and electrical terminal for electrical connection with a power supply.

14. The pool light fixture assembly as set forth in claim 10, wherein the return fitting includes a tapered nozzle end for connection with hoses of various diameters.

15. The pool light fixture assembly as set forth in claim 10, wherein the return fitting and the adapter are separate piece and removable from one another.

16. The pool light fixture assembly as set forth in claim 10, wherein the return fitting is removable from the pool wall.

17. The pool light fixture assembly as set forth in claim 10, wherein the adapter is removable from the return fitting.

18. The pool light fixture assembly as set forth in claim 17, wherein there is a gasket between the adapter and the return fitting.

19. The pool light fixture assembly as set forth in claim 12, wherein there are a plurality of light channels around the eyeball socket and a commensurate number of lights similarly around the eyeball socket, the lights defining a ring around the socket.

20. The pool light fixture assembly as set forth in claim 10, wherein the electrical channel is parallel to the adapter portion of the water channel but only parallel to a portion of the water channel of the return fitting.

21. A pool light fixture assembly for use with above ground and in-ground pools, the assembly connected to the pool wall, comprising:

a light adapter defining an internal body and having the water and electrical channels within the internal bodies, each of the channels parallel to one another, the light adapter including a light fixture member for connection with a light;

a return fitting defining an internal body and also having the water and electrical channels within the internal bodies, the water and electrical channels aligned and extending through each of the return fitting and the light adapter for allowing water to freely flow through the light fixture assembly and for allowing electrical connection with the light fixture member; and at least the light adapter portion of the electrical channel being parallel to and separate from the water channel and the electrical channel being within the internal bodies of the adapter and the return fitting, respectively.

22. The pool light fixture assembly as set forth in claim 21, wherein there are multiple water channels and a single electrical channel.

23. The pool light fixture assembly as set forth in claim 21, wherein the water channels surround the electrical channel.

* * * * *